United States Patent [19]

Kramers

[11] Patent Number: 4,554,121

[45] **Date of Patent: * Nov. 19, 1985**

[54] METHOD OF FORMING LATENT-CONTRACTABLE ELASTOMERIC COMPOSITE YARNS

[75] Inventor: Aloysius A. J. Kramers, Asheville, N.C.

[73] Assignee: Akzona Incorporated, Asheville, N.C.

[ * ] Notice: The portion of the term of this patent subsequent to Aug. 28, 2001 has been disclaimed.

[21] Appl. No.: 532,339

[22] Filed: Oct. 6, 1983

Related U.S. Application Data

[63] Continuation of Ser. No. 313,929, Oct. 22, 1981, abandoned, which is a continuation-in-part of Ser. No. 178,661, Aug. 18, 1980, abandoned.

[51] Int. Cl.[4] ..... D02G 3/02

[52] U.S. Cl. ..... 264/103; 57/225; 264/176 F; 528/272; 528/289

[58] Field of Search ..... 264/103, 176 F; 57/225; 528/272, 289

[56] References Cited

U.S. PATENT DOCUMENTS

| | | | |
|---|---|---|---|
| 1,860,030 | 5/1932 | Hinchliff | 57/226 |
| 2,783,609 | 3/1957 | Breen | 57/226 |
| 2,985,995 | 5/1961 | Bunting | 57/226 |
| 2,990,671 | 7/1961 | Bunting et al. | 264/168 |
| 3,013,379 | 12/1961 | Breen | 57/207 |
| 3,017,740 | 1/1962 | Humphreys | 264/342 RE |
| 3,041,812 | 7/1962 | Marshall | 57/350 X |
| 3,115,691 | 12/1963 | Bunting et al. | 264/168 |
| 3,234,725 | 2/1966 | Storti | 57/163 |
| 3,303,640 | 2/1967 | Reed et al. | 57/225 |
| 3,342,028 | 9/1967 | Matsubayashi et al. | 264/342 RE |
| 3,353,345 | 11/1967 | Setzer | 57/163 |
| 3,357,076 | 12/1967 | Greenwald et al. | 28/72 |
| 3,357,954 | 12/1967 | Kirkaldy | 528/83 |
| 3,364,537 | 1/1968 | Bunting et al. | 264/168 |
| 3,408,435 | 10/1968 | Logan, Jr. et al. | 264/210 |
| 3,412,547 | 11/1968 | Martin | 57/226 |
| 3,476,850 | 11/1969 | Matsubayashi et al. | 264/205 |
| 3,537,803 | 10/1970 | Epstein et al. | 264/210 |
| 3,609,953 | 10/1971 | Kitagawa | 57/226 |
| 3,679,633 | 7/1972 | Matsubayashi et al. | 264/210.8 |
| 3,701,248 | 10/1972 | Gray | 264/103 |
| 3,701,755 | 10/1972 | Sumoto et al. | 528/301 |
| 3,812,668 | 5/1974 | Wilson | 264/103 |
| 3,880,976 | 4/1975 | Sumoto et al. | 528/301 |
| 3,940,917 | 3/1976 | Strachan | 264/210.8 |
| 3,973,387 | 8/1976 | Familant | 242/159 |
| 3,991,548 | 11/1976 | Toronyl et al. | 264/103 |
| 3,998,921 | 12/1976 | Kohler et al. | 264/210 |
| 4,262,114 | 4/1981 | Wagner et al. | 528/301 |
| 4,467,595 | 8/1984 | Kramers | 264/176 F X |

FOREIGN PATENT DOCUMENTS

| | | |
|---|---|---|
| 657774 | 2/1963 | Canada . |
| 761720 | 6/1967 | Canada . |
| 784813 | 5/1968 | Canada . |
| 43-7426 | 3/1968 | Japan . |
| 711279 | 6/1954 | United Kingdom . |
| 996874 | 6/1965 | United Kingdom . |
| 1091422 | 11/1967 | United Kingdom . |

*Primary Examiner*—Philip Anderson

*Attorney, Agent, or Firm*—Jeffrey S. Boone; Jack H. Hall; Francis W. Young

[57] ABSTRACT

This invention relates to a process for forming composite yarns comprising an elastic filament and at least one relatively inelastic filament, which process comprises entangling a latent-contractable elastomer producing polymer filament with a relatively inelastic filament while the latent-contractable filament is relatively unelongated (less than tension maintained 100% elongation) or preferably substantially unelongated (merely taut) to produce a composite yarn which can be formed into a yarn package with minimum stored energy compared to conventional elastomeric yarn packages and which yarn can be processed (e.g., knitted or woven) into goods on equipment normally employed for non-elastic fiber processing; and yet which composite yarn upon actuation of the latent contraction within the polymeric filament provides a composite yarn which is elastic.

8 Claims, 2 Drawing Figures

METHOD OF FORMING LATENT-CONTRACTABLE ELASTOMERIC COMPOSITE YARNS

This is a continuation of application Ser. No. 313,929, filed Oct. 22, 1981, which in turn is a continuation-in-part of application Ser. No. 178,661, filed Aug. 18, 1980, and which both are now abandoned.

BACKGROUND OF THE INVENTION

While elastic fibers have been known and used for some time in making processed (e.g., woven or knitted) goods, their use is not without shortcomings. For example, because elastic yarns yield under tension, special equipment must be employed for collecting the fiber and for processing it into goods. Further, since elastic fibers generally have shortcomings, such as low strnegth, poor dyeability, poor light fastness, poor lubricity or poor hand and feel, they are frequently employed ultimately associated with one or more relatively inelastic companion fibers, such as, for example, by wrapping or comingling, so that the relatively inelastic fiber contributes its properties and/or masks the adverse properties of the elastic fiber. While this composite yarn concept has many benefits, it is not without its own problems. For example, the relatively inelastic yarn is an elongation limiting factor in relationship to the elastic yarn. Usually as the result of the need to render the composite yarn stretchable to the degree desired without breaking the relatively inelastic companion fiber, or since low modulus elastic fibers stretch significantly, the composite yarn is formed in a manner such that during the composite formation, the elastic fiber is stretched or elongated. The resultant wound package which results from these procedures has a large stored energy due to the high recoverable extension of the material on the package and this leads to excessive pressure on the package. To avoid multiplying these pressures and causing poor unwrapping characteristics, relatively small packages are formed. This, in turn, inherently leads to inefficiencies in processing these composite yarns into goods.

This application incorporates by reference in its entirety, the subject matter of grandparent application Ser. No. 178,661, filed Aug. 18, 1980, and now abandoned, which discloses melt extruded latent contractable elastic filaments which are formed by melt extruding certain segmented crosslinked thermoplastic polymers to form filaments, which filaments, when heat processed at elevated temperatures, significantly contract to yield an elastic filament. That application also discloses the formation of composite covered yarn comprising said latent contractable melt extruded filaments. In addition, that application discloses processes for forming articles from said latent contractable filaments or covered yarns comprising said contractable filaments and subsequently contracting said yarns to form an elastic article.

DESCRIPTION OF THE INVENTION

Figure 1:
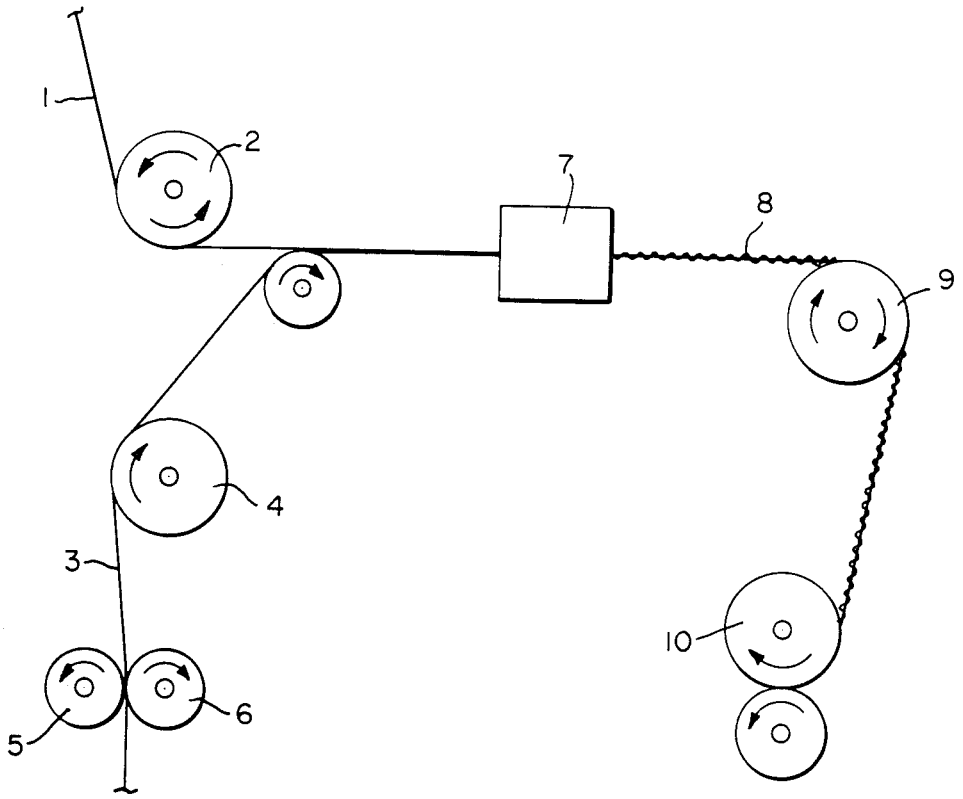
FIG. 1 is a schematic representation of a process for entangling a hard fiber yarn about a latent contractable elastomer forming polymer filament of the invention.

This invention relates to a process for forming composite yarn comprising an elastic filament and at least one relatively inelastic filament which process comprises entangling a latent-contractable elastomer-producing polymer filament with a relatively inelastic filament, while the latent-contractable filament is relatively unelongated (less than 100% tension-maintained elongation) or preferably substantially unelongated (merely taut) to produce a composite yarn which can be formed into a yarn package with minimum stored energy compared to conventional covered elastomeric yarn packages and which yarn can be processed (e.g., knitted or woven) into goods on equipment normally employed for non-elastic fiber processing; and yet which composite yarn upon actuation of the latent contraction within the polymeric filament provides a composite yarn which is elastic.

Latent contractable filaments which can be employed in this invention are formed by melt extrusion of certain segmented, crosslinked thermoplastic polymers, which, when in an elastic state, possess an amorphous soft segment. While not intending to be bound by any theory, it is believed that during melt extrusion, the ordinarily relatively unoriented soft segment is oriented, at least to some degree, followed by cooling, which fixes the filament in a relatively oriented state. Subsequently, when the filament is subjected to heat processing at an elevated temperature, the orientation of the soft segment created by the melt extrusion is dissipated, causing contraction of the filament and the creation of substantially increased elastic properties in the filament.

Polymers, which can be employed in the processes of the invention, include virtually any physically crosslinked polymer containing interspersed relatively soft and relatively hard segments which, when subjected to heat, contracts at least 15% in length compared to its original length to provide an elastic filament.

It is believed that many of the above polymers are ploymers consisting of a hard segment and a soft segment capable of forming one phase in the melt, which yield a poorly phase separated morphology when quenched and that, upon latent contraction by a heat treatment, produce a well phase separated morphology.

A particularly useful class of elastomers is described in U.S. Pat. No. 4,262,114, which is hereby incorporated by reference in its entirety. These elastomers comprise melt extruded thermoplastic segmented copolyester polyethers, consisting essentially of a multiplicity of randomly occurring intrachain segments of long-chain (soft segments) and short-chains (hard segments) ester units, said long chain ester units being represented by the following structure:

$$-\mathrm{OLO}-\overset{\overset{\displaystyle O}{\|}}{\mathrm{C}}-\mathrm{R}-\overset{\overset{\displaystyle O}{\|}}{\mathrm{C}}- \qquad \text{(a)}$$

where L is a divalent radical remaining after removal of terminal hydroxyl groups from poly (oxyalkylene) glycols having at least 1 nitrogen containing ring per molecule, a carbon to nitrogen ratio of from about 3/1 to about 350/1, and a molecular weight between 200 and 8,000, and R is a divalent radical remaining after the removal of the carboxyl groups from a dicarboxylic acid having a molecular weight of less than 300.

Short-chain ester units are represented by the following structure:

$$-OEO-\overset{O}{\overset{\|}{C}}-R-\overset{O}{\overset{\|}{C}}- \quad (b)$$

where E is a divalent radical remaining after removal of hydroxyl groups from a low molecular weight diol having 2 to 15 carbon atoms per molecule and a molecular weight between 50 and 250, and R is the divalent radical described for (a) above.

The introduction of a foreign repeat unit in the backbone of a crystallizable soft segment, such as a polyether, has an effect on the soft segment crystallization process. Such a foreign unit must be stable to processing temperatures and must not be so rigid as to reduce the mobility (raise the glass transition temperature) of the soft segment itself. The foregoing unit should be nonreactive during the synthesis of the segmented thermoplastic elastomer, and should be present in the concentration of at least 1 unit per polyether molecule.

A particular preferred polymer within the above described class is a melt extruded polymer consisting essentially of about 30% to about 60% by weight of polybutylene-terephthalate units and about 40% to about 70% by weight of hydantoin polyether units.

Another group of polyester-polyether polymers are the so-called Hytrel type copolyesters which contain a dimethylterephthalate-polytetramethylene ether glycol (molecular weight about 600 to 3000) derived soft segment and a dimethylterephthalate-1,4 butanediol derived hard segment. Preferably, these polymers contain at least about 40% soft segment.

Similar polyethylene terephthalate-polytetramethylene glycol copolymers as well as other polyester-polyether polymers are described in U.S. Pat. Nos. 3,880,976; 3,023,192; 3,652,014 and 3,701,755, which are hereby incorporated by reference.

Urethane based elastomers, assuming that they can be melt extruded to provide sufficient phase separation to display elasticity upon melt extrusion, will display the latent contraction phenomenon required by this invention. Likewise, copolyamides, polyamide-polyesters or polyamide-polyethers under the same assumptions will display latent contraction.

Yet another useful polymer group are segmented polyester copolymers, having both polyester hard segments and polyester soft segments. Segmented polymers of this type can be prepared by forming acid chloride terminated hard segments, for example, formed by reacting terephthalic acid chloride with ethylene glycol and then reacting this hard segment with a soft segment polyester, for example, hydroxyl terminated polybutyleneadipate. Preferably, these polyester-polyesters contain at least about 35% soft segment and most preferably at least about 40% soft segment.

Latent contractable filaments employed in the process of this invention can be formed by melt extruding the inherently elastomeric polymer in a conventional manner, preferably to form a filament having a denier of less than about 300, preferably between about 2 and about 250 denier, and most preferably between about 10 and about 75 denier.

The resultant melt extruded filaments at least have a reduced degree of elasticity as compared to the subsequent contracted filament.

In the process of the invention, the latent-contractable filaments are intermingled and companionized with relatively inelastic filaments (i.e., hard fibers) which can be any of the synthetic filaments or fibers commonly used for textile purposes. Elastic yarn covering techniques are known in the art. However, in the prior processes, the elastic yarn was covered in a stretched condition in order to prevent the covering hard fibers from retarding desired extensibility.

In the present invention, the latent-contractable elastic filaments are intermingled in their essentially or relatively unstretched state in a manner such that the heat processed contracted elastic filament when stretched will be limited in its extensibility by the extensibility of the intermingled, companionized hard fiber yarns.

In the preferred assembling process of the invention, the precontraction elastomer forming polymer filaments are comingled with at least one and preferably at least three relatively inelastic filaments (hard fibers) to protect the elastic filament and provide desirable textile properties. The resultant composite yarn upon heat (preferably wet) processing, yields a contracted bulky, elastic yarn which is capable of being extended at least 50% and preferably 100% of its contracted relaxed length when stretched until the relatively inelastic filaments first become load bearing. When stretched until the hard fibers first become load-bearing, the composite yarn is characterized by load-bearing, relatively inelastic filaments entangled with the elastic yarn in intermittent zones of random braided structure and otherwise extending substantially parallel to the elastic yarn, there being an average entanglement spacing of less than 10 centimeters and the filaments being free from crunodal or other surface loops when the composite yarn is examined in the stretched condition.

The composite yarn preferably has substantially zero unidirectional torque. The relatively inelastic filaments preferably have crimp when relaxed. The crimp is preferably such that the relatively inelastic filaments form undulations and twist pigtails when the composite yarn is relaxed. In accordance with a preferred embodiment, the relatively inelastic filaments form reversing helical coils when the composite yarn is relaxed. The relatively inelastic filaments may be bicomponent filaments which crimp when relaxed before or after crimp development.

The composite yarn after latent contraction preferably has a break elongation of 50 to 350 percent or more. Generally, the elastic portion of the composite yarn shows no evidence of crimp, twist or torque produced by the operation of combining the hard fiber filaments with the elastic yarn.

The composite yarn of this invention can be produced at feed rates of up to about 2000 meters per minute, or higher, by continuously feeding the elastic yarn with the relatively inelastic filaments through jetted high velocity fluid and impinging the jetted fluid on the yarn axis at an angle of 90°±45° to entangle the filaments around the elastic yarn in intermittent zones of random braided structure. Usually, the precontraction elastomer forming polymer filament is fed to the jetted fluid under predetermined tension sufficient to modestly stretch the filament (less than 100% elongation), if desired, or merely to maintain it relatively taut (essentially unelongated). The relatively inelastic filaments (hard fibers) are simultaneously fed at a rate which is approximately equal to the rate at which the melt extruded filament is fed or which provides a net overfeed of hard fibers to the jetted fluid. Preferably, the composite yarn is wound on a package under controlled tension.

Suitable hard fiber filaments or fibers include any synthetic textile filaments or fibers of relatively inelastic material such as nylon, e.g., nylon 6 and nylon 6.6; a polyester, e.g., polybuthlene terephthalate, and polyethylene terephthalate, polypropylene, cellulose acetate; regenerated cellulose, etc. The hard fiber filaments may be fed to the jetted fluid as a single filament or as a bundle or preferably at least three filaments and may be of more than one material. The bundle preferably has less than ½ turn per inch of twist and the filaments must be capable of being separated by the jetted fluid.

If desired, two or more precontraction elastomer forming polymer filaments may be fed and comingled with the inelastic filaments, the plurality of elastomer forming polymer filaments being separated at least temporarily by the jetted fluid to, if desired, insert portions of the relatively inelastic filaments between the elastomer forming polymer filaments.

The fluid used is preferably compressed air, although other fluids can be used; it is usually at ambient temperature. The fluid is preferably impinged on the yarn from more than one direction, each substantially perpendicular to the yarn axis.

The rate of feed of the inelastic filaments in relation to the precontraction elastomer forming polymer filaments is determined by the degree of extension desired in composite yarn before the inelastic filaments become load-bearing. For any given filament and intended heat processing conditions, one can determine the amount of contraction to be obtained. Since it is desired that the contracted elastic filament of the invention be extendable at least 50% and preferably between about 100% and 350%, the amount of inelastic filament fed should be that amount which becomes load-bearing at the desired maximum extension of the contracted elastic filament.

Thus, since typically the desired extensibility of the contracted elastic filament is the contracted relaxed length multiplied by about 1.50 to about 6, preferably about 1.75 to about 4, and, since typically the contracted relaxed length of the heat processed elastic filament is about 40% to about 75% of the precontraction filament length, the desired rate of feed of the inelastic filament and the precontraction elastomer forming polymer filament can be readily calculated for a given desired composite yarn. For example, if a heat processed elastic filament is contracted 50% based on the starting filament and the desired extensibility is 100% (contracted length×2), the rates of feed of the inelastic filaments and the elastomer forming ploymer filament should be equal. On the other hand, if the desired extensibility of the 50% contracted relaxed filament is 150% (contracted relaxed length×2.5), the rate of feed of the inelastic filaments should be 25% greater than the rate of feed of the melt extruded filament. These calculations assume no extensibility is inherent in the inelastic companion filament. However, where the inelastic companion filament is crimped or otherwise yieldable, obviously the relative feed rates must be adjusted to attain the desired maximum extensibility of the resultant composite yarn.

In order that the relatively inelastic yarn protects the elastic filament from breaking, it is preferable that the elastic filament be mingled with the inelastic yarn in a manner so that, after the inelastic filament has been contracted by a heat treatment, the relatively inelastic yarn becomes load-bearing at less than about 95% of the break elongation of the elastic filament.

With reference to FIG. 1, a precontraction elastomer-forming polymer filament 1 from a supply source is supplied, at a given rate, by driven feed roll 2 to a fluid jet intermingling device 7, while relatively inelastic filaments 3, from a supply source, are supplied at a given rate by rolls 4, 5, and 6, the same as or different from the elastomer forming polymer filament supply rate to the fluid jet intermingling device 7. The two filament supplies pass through a fluid intermingling jet device 7, which may have filament guides at the entrance and exit to center the filaments within the jet which intermingles the hard fiber filaments with the elastomer forming polymer filament. The resultant composite yarn 8 then passes about roll 9 and then to a windup device and package 10.

Figure 2:
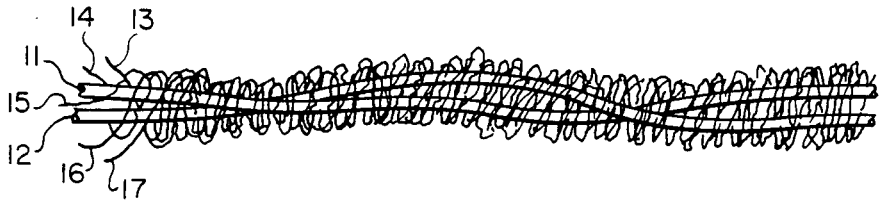
FIG. 2 illustrates a composite yarn obtained by the process of FIG. 1.
Figure 3:
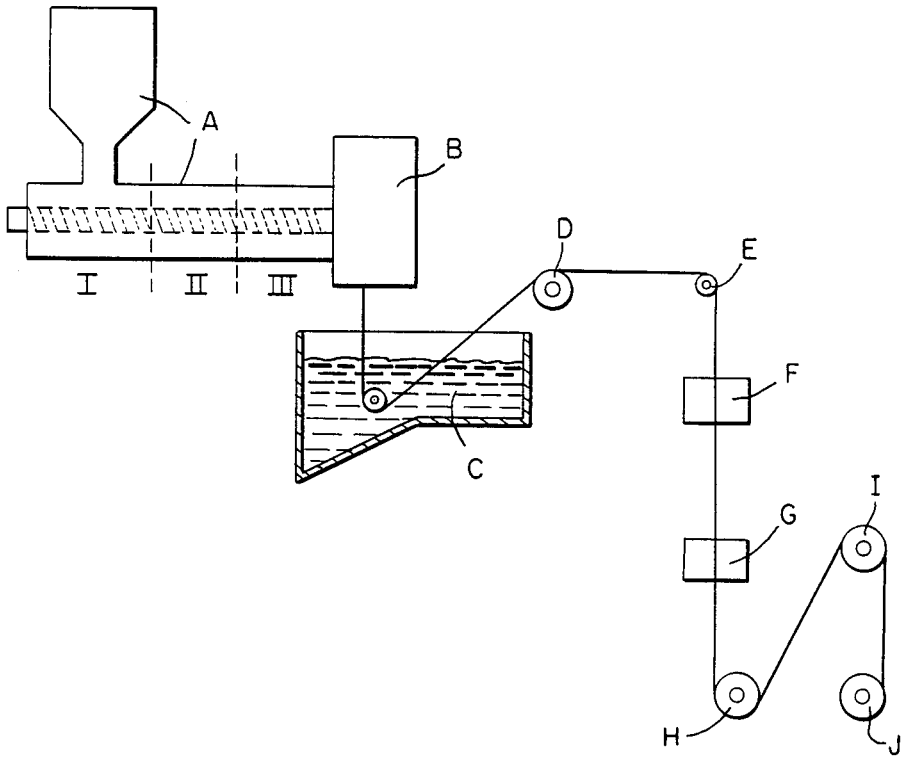

With reference to FIG. 2, a useful composite yarn comprises, for example, two heat contractable elastic filaments 11 and 12, intermingled with five inelastic filaments 13, 14, 15, 16 and 17.

The fluid jet intermingling device may be one of those shown in Bunting et al. U.S. Pat. Nos. 3,364,537 and 3,115,691 or McCutchan U.S. Pat. No. 3,426,405, for example, in which one or more fluid streams impinge on the yarn line at an angle of 90°±45°. The essential requirement is that the hard fiber filaments be subjected to a fluid stream having an appreciable component of force at right angles to the filament to separate them and force them around the inherently elastic yarn and around and between other hard fiber filaments to intermingle the hard fiber filaments by a random braiding action intermittently along the length of the composite yarn. If fluid yets are directed at the yarns at an angle of less than 45°, the fluid forces parallel to the yarns tend to be greater than those transverse to the yarns, thereby tensioning the filaments and tending to form stable loops rather than braiding them. It is also necessary to avoid a predominantly unidirectional fluid twisting vortex, since such action tends to wrap the filaments around the yarn rather than randomly braiding them. Jets having a unidirectional twisting effect are suitable for the present process only when a yarn oscillates rapidly between a region of fluid torque operating in one direction and a region of opposite torque, as in Bunting el al. U.S. Pat. No. 2,990,671.

While in the intermingling process, the elastomer forming polymer filament and the inelastic companion filaments can be fed at greatly varying rates relative to each other, because of the subsequent contractability of the melt extruded filament, it is not necessary to overfeed the inelastic companion filaments at rates as high as heretofore considered appropriate. Thus, a preferred process comprises continuously feeding at least one elastomer forming polymer filament at a first predetermined feed rate and relatively inelastic filament(s) at a second predetermined feed rate through jetted high velocity fluid to entangle the inelastic filament around the elastomer forming filament at spaced intervals, the rate of feed of the inelastic filaments being adjusted to the rate of feed of the elastomer forming polymer filaments so that the rate of feed of the inelastic filaments is less than twice the rate of feed of the elastomer forming polymer filament and is a rate such that after the resultant composite yarn is exposed to an elevated contraction inducing temperature whereby the elastomer forming polymer filament is contracted at least about 15% to provide an elastic filament, when the resultant composite yarn is stretched, the inelastic filaments become load-bearing at a predetermined percent of elastic stretching below the break elongation of the elastic filament. That is to say, the precontraction filament and inelastic filament are fed at rates adjusted to form a composite yarn which has the desired elastic extensibility properties after the composite yarns have been heat treated to contract the elastomer forming filament. Because the elastic filament formed by the heat treatment is shortened, the inelastic filament need not be overfed or at least need not be overfed to high rates to achieve the desired elastic extensibility. In any event, upon stretching, it is desired that the inelastic filaments become load bearing before the break elongation of the elastic filament is reached.

In at least one combination of the invention, it is preferred that the relatively inelastic companion filament (filaments) are load-bearing, or at least carry a majority of the load of the winding tension, to assure that the amount of stored energy in the package is minimized. If desired, this fact can be accentuated by forming the composite yarn with a slight underfeed of the relatively inelastic filament(s) in comparison to the latent contractable elastic filament.

The hard fiber multifilaments consist of relatively inelastic continuous filaments of any commonly available textile material. Nylon is generally preferred because of its high strength and low friction. Either uncrimped or crimped yarn may be employed, but crimped or crimpable yarns must be capable of being held loop-free at the tension required to entangle the filament around the core and wind the composite yarn on a package. Tension-stable textured yarn of Breen U.S. Pat. No. 2,783,609, for example, which has crunodal surface loops which do not open when held at tension, is unsatisfactory for the purpose of the present invention. Two or more different multifilament yarns may be employed, for example, nylon to give strength at ultimate extension and cellulose acetate to provide luxurious textile aesthetics when the fabric is relaxed. Two yarns having differential shrinkage properties may be employed for certain effects. For example, an untextured polyester yarn having high potential shrinkage (but substantially less than the elastomer) may be fed with a textured nylon yarn having a potential shrinkage less than the polyester yarn and be entangled around a melt extruded core yarn wherein both hard fiber yarns are at the same tension during entangling, and, in contrast to those of Breen above, remain loop free when wound on the package. When such yarn is made into fabric and the fabric is heat treated under relaxed conditions, the polyester will shrink while the nylon develops crimp. When the treated fabric is then stretched, the polyester will become the load-bearing member to limit the ultimate extension of the composite yarn and will permit the textured nylon to retain a degree of crimp and bulk even at ultimate extension of the composite.

When the hard fiber component of the present composite yarn is crimped or crimpable, the retractive power of such yarn may be less than that normally required when these filaments are used alone, since the elastic portion of the present composite yarn furnishes the major retractive power of the composite. The hard fiber filaments, therefore, need only have sufficient crimping ability to form the crimps, twists or coils desired for imparting bulk, opacity or tactile aesthetics to the final fabric. These filaments, therefore, will be processed at higher speeds or under less stringent texturing conditions than would normally be required. This may permit falsetwist texturing, for example, to be performed on hard fiber which is then fed directly into the entangling step in a single continuous process.

There should be at least one and preferably at least three hard fiber filaments. More filaments are generally desirable to provide more chances for intermingling, and more thorough protection for the elastic yarn. Low denier per filament in the hard fiber yarn is generally conductive to better intermingling, the smaller filaments being more easily formed into a random braid. In the case of stretch textured or bicomponent yarns, low denier per filament favors formation of small, fine coils when relaxed. Low bending modulus in the hard fiber filaments is also conducive to improved intermingling.

The hard fiber feed yarns should have low twist, preferably not more than the 0.2 to 0.5 turns per inch known as "producer twist", or more preferably zero twist. High twist interferes with opening of the filament bundle during the process of intermingling and surrounding the elastic core. Feed yarns having zero or low twist may have interlace as described in Bunting et al. U.S. Pat. No. 2,985,995, but they should not have such a large degree of interlace that the filaments are unable to separate for random braiding in the present process. For the present purposes, a yarn having the lowest degree of interlace consistent with processing, winding, and unwinding is preferred, no interlace being most preferable.

The yarns should not have size or finish of such a cohesive nature that it prevents the bundle from opening during the intermingling process although certain finishes may be desirable which allow the bundles to open, but aid in retaining intermingling subsequently. Finishes disclosed in Gray U.S. Pat. No. 3,701,248, for example, may be used to improve the performance of yarns.

When the composite yarn produced by the process of this invention is wound upon a hollow core or spool adapted for use on processed goods forming machinery, preferably at about 10 grams or less winding tension, there results a package which can contain substantially more yarn than is conventionally contained on commonly used elastomeric yarn packages. For example, a commonly used hollow paperboard core has an inner diameter of about 3 inches and an outer diameter of about 3.5 inches and a length of about 8½ inches. When used to package a conventional elastomer yarn such as covered spandex, normal practice limits the filament yarn content to 2 pounds or less due to the crushing strength of the core and the unwinding difficulties encountered due to stored energy. On the other hand, because the yarns produced by the process of the invention have reduced stored energy (generated if the elastomeric property contributing filament is wound with tension induced elastomeric elongation, packages containing in excess of 3 pounds of yarn per 8 inch core length (or other size packages in the same weight-/length ratio, i.e., at least about 0.35 pound of yarn per core inch length) are possible without undue pressure on the core, or fiber package which would cause yarn or filament breakage due to pressure induced winding irregularities.

The latent contractable filaments within the yarns formed in the process of the invention are contractable by heat processing at an elevated temperature which is a contraction inducing temperature below the polymer softening temperature generally in the range of about 40°-125° C., preferably between about 80°-100° C. and for a time sufficient to contract the length of the contractable filament at least 25% and preferably at least 40% as compared to its precontracted length. Generally, the temperature employed is at least about 15° C. lower than the polymer softening point. The time for contraction varies with the type of polymer and the temperature. Thirty minutes at 90°-100° C. is generally effective to obtain significant contraction. As most filaments employed in fabric are at some point wet processed, a preferred method of contraction comprises processing the filaments in an aqueous medium at a contraction-inducing temperature of at least about 40°-60° C. for a time sufficient to cause the filament to linearly contract at least about 15% and preferably at least about 40% of its original length.

The contractable inherently elastic composite yarns of the invention are especially useful in a process which generally comprises forming a stretchable textile article which comprises forming a predetermined over-sized article with the composite yarns comprising a latent contractable filament which contracts at least 15% as compared to its original length when exposed to an elevated contraction inducing temperature to provide an elastic filament containing yarn and exposing the resultant textile article to an elevated temperature sufficient to contract said latent contractable filament with the composite yarn at least about 15% to form a stretchable article of desired size. Usually, the contractable filament containing composite yarn is interspaced unidirectionally or multidirectionally within the textile article.

It is noted that the heat processing step need not be carried out as a separate step, but can be and most desirably is conducted in conjunction with at least one other, for example, aqueous, elevated temperature treatment step such as washing, dyeing, sizing and the like.

The heat processed contracted elastic filaments within the composite yarn formed by the process of the invention preferably have an elastic modulus of at least about 0.01 grams per denier (g/D), preferably between about 0.05 g/D and about 0.5 g/D and most preferably between about 0.2 g/D and about 0.4 g/D measured at 100% extension. The preferred filaments of the invention are those which have a medium elastic modulus, i.e., between about 0.2 g/D and 0.4 g/D at 100% extension. Filament containing composite yarns provide processed articles which provide relatively high compression and relatively low extension.

The following Example illustrates the invention and what is now considered its best embodiments. As throughout the specification, all parts and percentages are by weight, and all temperatures are degrees Centigrade, unless otherwise specified.

EXAMPLE

The 42 denier elastic yarn of Example 1 of said copending application Ser. No. 178,661, before contraction, and a 25/5 textured nylon yarn were combined and fed to an air tangling jet. A standard polyester finish was applied by means of a kiss-roll finish applicator. The combined yarns passed over two godets running at 1650 rpm and onto a winder. The combined yarn was wound on an 8½"-long tube having a thickness of 0.5" at about 10 gram tension.

An elastic yarn package containing the combination of the above elastic filament and companion filament and 20/5 stretch nylon cationic dyeable companion yarn was positioned on a horizontal creel of a four-feed high speed (800 rpm) 51 gauge panty hose machine. The elastic yarn was knit in every fourth course of the panty portion at about 3 gram tension. The other 3 feeds knitted a 50 denier stretch nylon cationic dyeable filament yarn. The stitch construction was set on 1×1 rib.

The band was made in a 3×1 construction of a conventional 560 denier base spandex with a 50 denier cationic dyeable nylon filament, so that the entire panty hose top could be dyed with basic dyes for style purposes. The leg portion, knitted from regular dyeable nylon stretch filament yarn, plain or in combination with regular nylon covered spandex, can be dyed with acid dyes or disposed dyes. After knitting an oversized garment, the toes of the hosiery panels were closed and the panty portions were slit to construct the total panty hose panty, while a pre-knitted cotton crotch was sewn in.

The completed panty hose garment was dyed starting with clean hosiery paddle dyeing machines.

Dyeing formulations were added and initial dyeing was run for 10-15 minutes. The bath temperature was raised to 100° C. at a rate of 3° per minute, at which temperature the hose were dyed for 30 to 40 minutes. The latent contraction of the elastic filaments occurred during the dyeing step.

After draining the bath, and gradually cooling the yarn, two 5-minute rinses were given wherein the final rinse a 2% softener or finish was added for hand and stretch performance.

Additional samples were made, as above, in which the ratio of hard segments to soft segments were 50:50 and 60:40, respectively. The boiling water contraction of the 50:50 PBT/HPOE was 37%, while that of the 60:40 PBT/HPOE was 17%.

What is claimed is:

1. A process for producing a latent-contractable elastomeric composite yarn, comprising:

(a) an elastomer component consisting of at least one essentially undrawn latent contractable polymer filament which, upon heat treatment, contracts at least 15% of its original length to provide an elastomeric filament, and (b) at least one relatively inelastic companion filament, said process comprising feeding said filaments (a) and (b) into an air jet adapted to intermingle said filaments to provide a unitary composite yarn, said filament (a) being fed to said air jet in at least a taut, essentially non-elastically tension-elongated condition, but at less than 100% elastically tension-elongated, while said filament (b) is fed at a rate about equal to the feed rate of (a) or greater than the feed rate of (a) to provide an intermingled unitary composite yarn which, when heat treated, is an elastic yarn wherein the filament (b) becomes load bearing at less than about 95% of the break elongation of said filament (a).

2. The process of claim 1, wherein the filament (a) contracts at least 40% of its original length upon heat treatment.

3. The process of claim 1, wherein the filament (a) is relatively less elastic prior to heat treatment.

4. The process of claims 1, 2 or 3, wherein the filament (a) is fed to the air jet in a taut but essentially elastically unelongated condition.

5. The process of claims 1, 2 or 3, wherein the intermingled unitary yarn is collected as a package wound upon a hollow core with the filament (a) in an elastically unelongated state or elastically elongated less than about 100%.

6. The process of claim 5, wherein the filament is fed to the air jet in a taut but essentially elastically unelongated condition.

7. The process of claims 1 or 2 where the latent contractable polymer is a melt extruded, segmented, inherently elastic polyester-polyester or polyester-polyester thermoplastic polymer.

8. The process of claim 4 where the latent contractable polymer is a melt extruded, segmented, inherently elastic polyester-polyester or polyester-polyether thermoplastic polymer.

* * * * *